US008292413B2

(12) United States Patent
Park et al.

(10) Patent No.: US 8,292,413 B2
(45) Date of Patent: Oct. 23, 2012

(54) BIDIRECTIONAL INK PUMP

(75) Inventors: Daniel Clark Park, West Linn, OR (US); Isaac S. Frazier, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 345 days.

(21) Appl. No.: 12/643,227

(22) Filed: Dec. 21, 2009

(65) Prior Publication Data

US 2011/0148957 A1 Jun. 23, 2011

(51) Int. Cl.
*B41J 2/175* (2006.01)

(52) U.S. Cl. ..... 347/85

(58) Field of Classification Search ..... 347/6, 85
See application file for complete search history.

(56) References Cited

U.S. PATENT DOCUMENTS 6,234,620 B1 5/2001 Faisst, Jr. et al.
7,048,353 B2 5/2006 Waller et al.
7,828,425 B2 * 11/2010 Kang et al. ..... 347/93
2007/0052762 A1 3/2007 Nawa
2009/0219324 A1 9/2009 Esdaile-Watts et al.

* cited by examiner

*Primary Examiner* — An Do
(74) *Attorney, Agent, or Firm* — Maginot, Moore & Beck, LLP

(57) ABSTRACT

An ink delivery and recovery system includes a first reservoir for containing ink for delivery to a plurality of ink jets of an imaging device, a second reservoir spaced apart from the first reservoir for containing ink for delivery to the first reservoir, and a third reservoir for capturing ink emitted from the plurality of ink jets. A first conduit is connected to the first reservoir and configured to permit flow of ink in a single direction toward the first reservoir. A second conduit is connected to the third reservoir and configured to permit flow of ink in a single direction away from the third reservoir. A third conduit is connected between the second reservoir and the first conduit and second conduit, the third conduit being configured to permit bidirectional flow of ink from the second reservoir toward the first and second conduits and from the first and second conduits toward the second reservoir. A bidirectional pump is associated with the third conduit.

16 Claims, 5 Drawing Sheets

BIDIRECTIONAL INK PUMP

TECHNICAL FIELD

This disclosure relates generally to phase change ink imaging devices, and, and, in particular, to the delivery and recovery of melted phase change ink in such phase change ink imaging devices.

BACKGROUND

In general, ink jet printing machines or printers include at least one printhead that ejects drops or jets of liquid ink onto a recording or image forming media. A phase change ink jet printer employs phase change inks that are solid at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In various modes of operation, ink may be purged from the printheads to ensure proper operation of the printhead. When a solid ink printer is initially turned on, the solid ink is melted or remelted and purged through the printhead to clear air bubbles and/or contaminants from the printhead. The word "printer" as used herein encompasses any apparatus, such as digital copier, bookmaking machine, facsimile machine, multi-function machine, etc. that performs a print outputting function for any purpose. When ink is purged through the printhead, the ink flows down and off the face of the printhead typically to a waste ink tray or container positioned below the printhead where the waste ink is allowed to cool and re-solidify. The waste ink collection container is typically positioned in a location conveniently accessible so that the container may be removed and the waste ink discarded.

As an alternative to removing and discarding the waste phase change ink, some previously known systems have been configured to recycle the waste ink by directing it back to the melt reservoir that supplies the printhead with the melted phase change ink for jetting onto the image receiving substrate. Such systems typically use both positive and negative air pressure for pressurizing the reservoirs to force ink through the system in the desired direction.

SUMMARY

As an alternative to using positive and negative air pressure to deliver melted phase change ink from a remote reservoir to the printheads and to recover waste ink from a waste ink collector back to the remote reservoir, a phase change ink delivery and recovery system has been developed that enables both ink delivery and recovery operations to be performed using a single pumping system. Such a system utilizes a bidirectional rotary displacement pump in a fluid path that connects a remote reservoir to both the on-board printhead reservoir and the waste ink collector. The bidirectional rotary pump is configured to pump ink in a first direction or a second direction based on the rotational direction of the pump. For example, the rotary displacement pump is configured to rotate in a first direction which displaces melted phase change ink in a direction from the remote reservoir toward the on-board printhead reservoir and to rotate in a second direction which displaces ink in a direction from the waste ink collector toward the remote reservoir.

In one embodiment, an ink delivery and recovery system includes a first reservoir for containing ink for delivery to a plurality of ink jets of an imaging device, a second reservoir spaced apart from the first reservoir for containing ink for delivery to the first reservoir, and a third reservoir for capturing ink emitted from the plurality of ink jets. The system includes a first conduit connected between the first reservoir and a conduit junction that is configured to permit flow of ink in a single direction toward the first reservoir. The system also includes a second conduit connected between the third reservoir and the conduit junction that is configured to permit flow of ink in a single direction away from the third reservoir. A third conduit is connected between the second reservoir and the junction. The junction fluidly connects the first, second, and third conduits. A bidirectional pump is associated with the third conduit for pumping ink in a first direction and a second direction in the third conduit, the first direction causing ink to flow from the second reservoir toward the junction.

In another embodiment, a method of operating a phase change ink imaging device is provided. The method includes connecting a first conduit to an on-board printhead reservoir of a phase change ink imaging device; connecting a second conduit between a remote reservoir of the phase change ink imaging device and the first conduit; and connecting a third conduit between a purged ink collecting reservoir of the phase change ink imaging device and the second conduit. A bidirectional pump is positioned in the second conduit that is configured to pump ink in a first direction in the second conduit and to pump ink in a second direction in the second conduit opposite the first direction.

DETAILED DESCRIPTION

Figure 1:
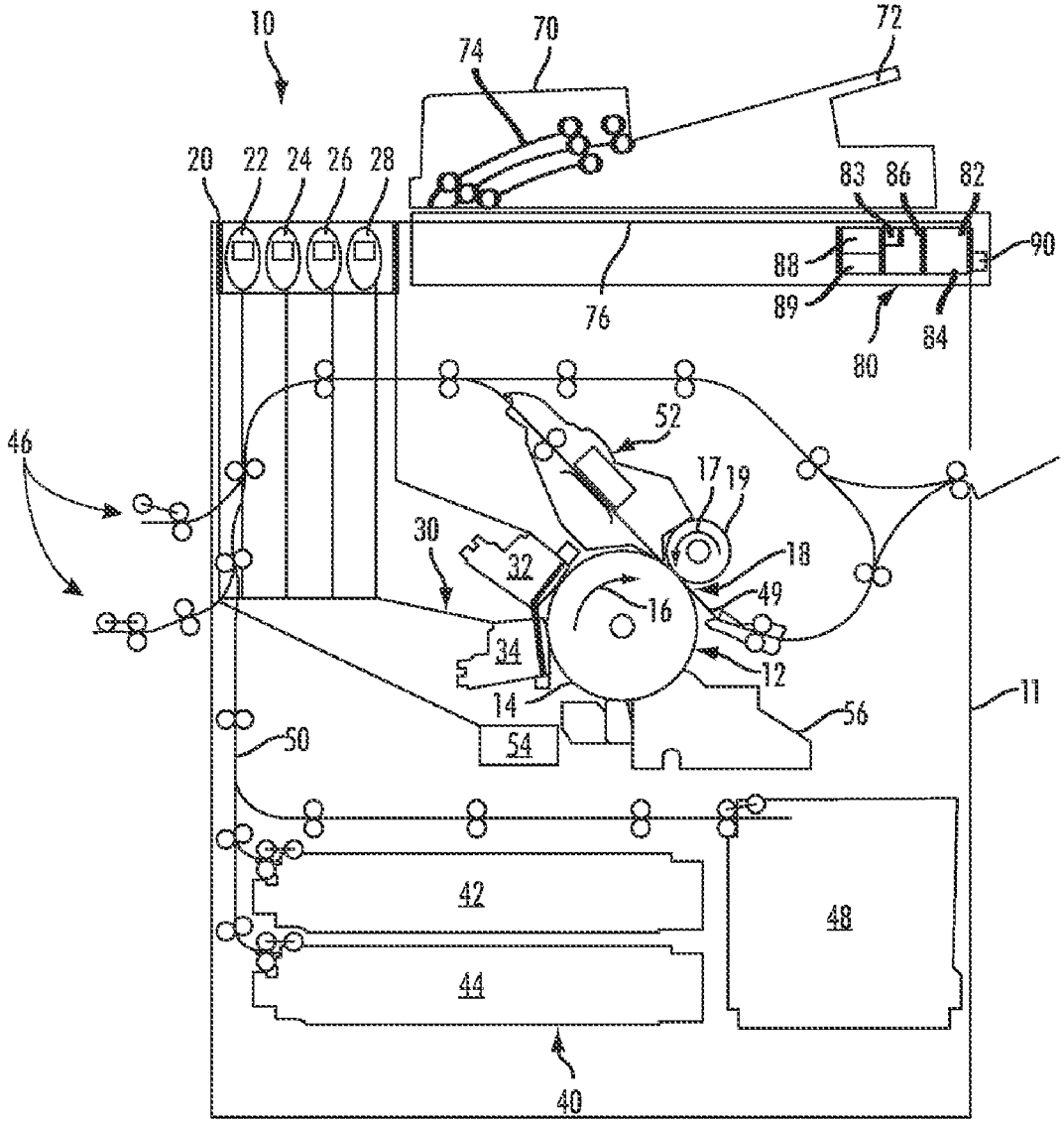
FIG. 1 is block diagram of a phase change ink image producing machine.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a usually non rigid physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. As used herein, the term "consumable" refers to anything that is used or consumed by an imaging device during operations, such as print media, marking material, transfer fluid, and the like. An image generally may include information in electronic form which is to be rendered on the print media by the image forming device and may include text, graphics, pictures, and the like. The operation of applying images to print media, for example, graphics, text, photographs, etc., is generally referred to herein as printing or marking.

Referring now to FIG. 1, an embodiment of an imaging device 10 of is shown. As depicted, the device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in the direction 16, and on which phase change ink images are formed. A transfer roller 19 rotatable in the direction 17 is loaded against the surface 14 of drum 12 to form a transfer nip 18, within which ink images formed on the surface 14 are transferred onto a media sheet 49. In alternative embodiments, the imaging device may be a direct marking device in which the ink images are formed directly onto a receiving substrate such as a media sheet or a continuous web of media.

In one embodiment, the ink utilized in the imaging device 10 is a "phase-change ink," by which is meant that the ink is substantially solid at room temperature and substantially liquid when heated to a phase change ink melting temperature for jetting onto an imaging receiving surface, also referred to as solid ink sticks or blocks. Accordingly, the imaging device 10 includes a solid ink loading system 20 that is configured to receive phase change ink in solid or substantially solid form, and a phase change ink melting system 30 (FIG. 2) that is configured to melt the solid ink into a liquid form for jetting onto the imaging member 12.

As depicted in FIG. 1, the ink loading system 20 includes at least one solid ink receiving station, such as receiving station 22, that is configured to receive at least one color or shade of solid ink stick. Because the imaging device 10 is a multicolor imaging device, the ink loading system includes four receiving stations 22, 24, 26, 28, representing four different colors CYMK (cyan, yellow, magenta, black) of ink. In one embodiment, the receiving stations comprise insertion openings that permit ink sticks to be inserted into an appropriate delivery channel or chute. The feed channels guide ink sticks to a corresponding melt assembly 30. A separate feed channel (not shown) and melt assembly (not shown) may be associated with each color or shade of ink utilized in the device 10. Each ink melting assembly 30 is configured to heat the solid phase change ink to a melting temperature that phase changes, i.e., melts, the solid ink to its liquid or melted form for jetting onto the imaging member by the printhead assemblies.

The phase change ink melting temperature may be any suitable temperature based on such factors as ink formulation, environmental conditions, desired flow rate of the ink, etc. In one embodiment, the phase change ink melting temperate is in the range of approximately 100° C. to 140° C. Although the ink for use with the imaging device of FIG. 1 has been described as phase change ink, in alternative embodiments, the ink utilized in the imaging device may be any suitable type of ink that is capable of being jetted or otherwise deposited onto the imaging member. For example, the ink may comprise liquid or substantially liquid ink, such as aqueous ink, UV curable ink, wax-based inks, and the like.

Figure 2:
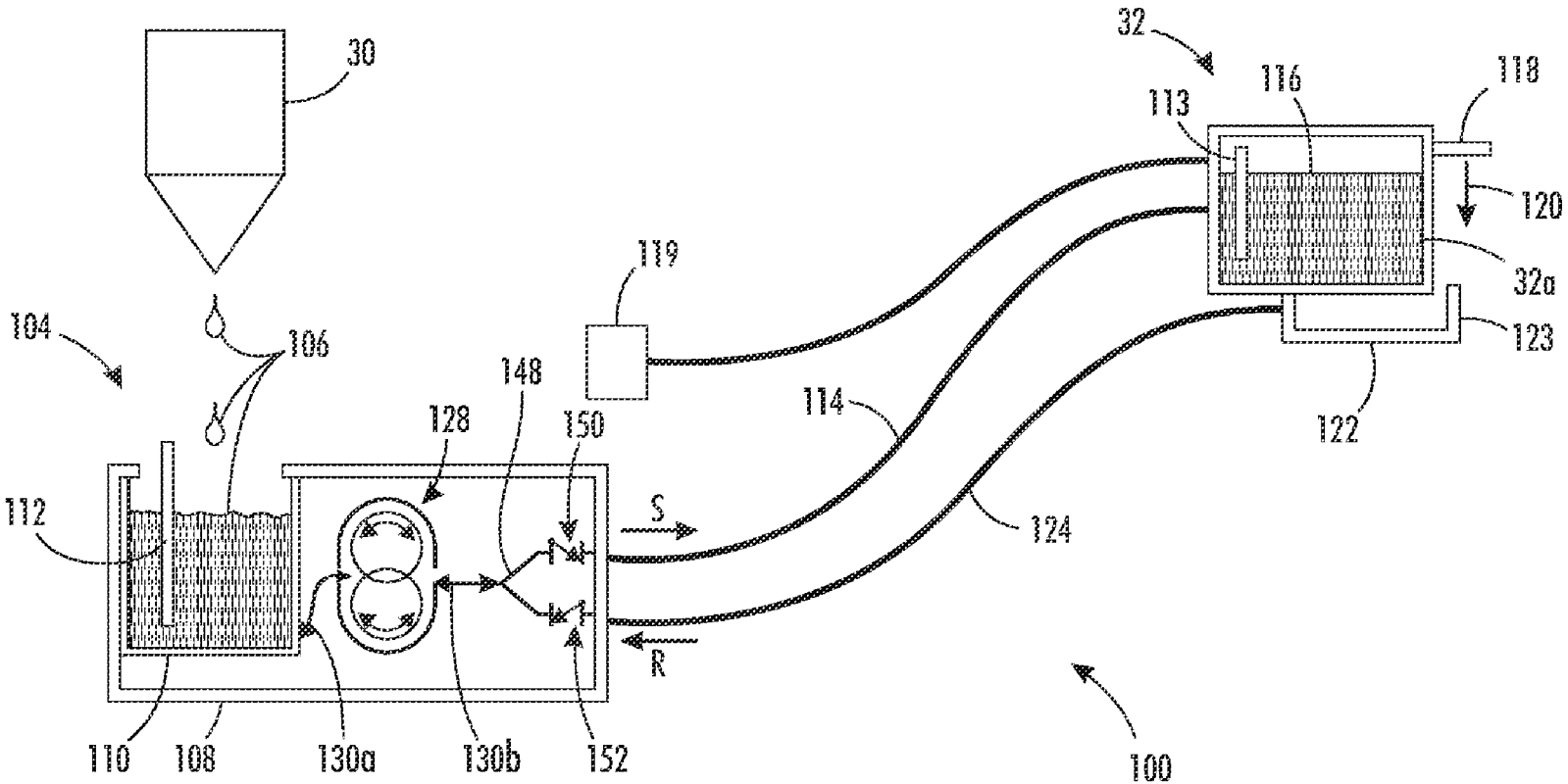
FIG. 2 is a schematic diagram of the ink delivery and recovery system of the device of FIG. 1.

The imaging device includes at least one printhead assembly configured to receive molten ink from a corresponding melting assembly and to jet the molten ink to form images on the imaging drum. Each printhead assembly extends substantially across the width of the imaging drum in the cross-process direction. In embodiments, the imaging device 10 may include a separate printhead assembly for each color or shade of ink utilized in the device. For example, in the case of the four colors of ink CMYK, the imaging device may include four printhead assemblies. For simplicity, only two printhead assemblies 32, 34 are depicted in FIG. 1. Each printhead assembly is associated with a molten ink delivery and recovery system 100 (FIG. 2). A molten ink delivery and recovery system for a printhead assembly is configured to receive molten ink of the appropriate color from a corresponding ink melting assembly 30. As explained below, a molten ink delivery and recovery system 100 is configured to hold quantities of the appropriately colored molten ink and to deliver it as needed to the associated printhead assembly for jetting onto the imaging drum.

As further shown, the imaging device 10 includes a media supply and handling system 40. The media supply and handling system 40, for example, may include sheet or substrate supply sources 42, 44, 46, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies. Additionally, the controller determines and/or accepts related subsystem and component controls, for example from operator inputs via the user interface 86, and accordingly executes such controls. As a result, appropriately colored phase change ink is melted and delivered to the printhead assemblies. Additionally, pixel placement control is exercised relative to the imaging surface 14 thus forming desired images per such image data, and receiving substrates are supplied by anyone of the sources 42, 44, 46, 48 in timed registration with image formation on the surface 14. Finally, the image is transferred within the transfer nip 92, from the surface 14 onto the receiving substrate.

Referring now to FIG. 2, a schematic diagram of an embodiment of a molten ink delivery and recovery system 100 for the imaging device 10 is shown. The molten ink delivery and recovery system 100 of FIG. 2 includes at least one remote molten ink reservoir 104 for receiving molten ink 106 from an associated ink melting assembly 30 of the imaging device 10. Melt reservoir 104 includes a housing 108 that defines a receptacle 110 for receiving the molten ink from the melt assembly 30. An ink level sensor 112 may be provided in the receptacle area for detecting the level of ink therein. Any suitable type of ink level sensor may be used. In operation, the melt assembly is activated to melt ink based on the ink level sensor output to provide and maintain a desired amount of molten ink in the melt reservoir 104.

The reservoir also includes a heating system to maintain the received ink at a suitable temperature for delivery to the printhead assembly 32. For example, in embodiments, the housing formed of a suitable thermally conductive material, such as metal or thermally conductive plastic, to which a suitable heater is mounted. The heater heats the housing which in turn transfers the heat to the ink contained therein. In alternative embodiments, the housing may be formed of a thermally insulative material, and suitable heating may be generated by mounting a heating device internal to the housing. The thermally insulative housing then operates to prevent or limit heat loss from the interior of the housing.

The melt reservoirs 104 are configured to transport the molten ink to at least one printhead assembly, such as printhead assembly 32, as needed via a molten ink delivery path. The molten ink received in the remote reservoir 104 is directed to the printhead 32 via an ink delivery path 114. The ink delivery path 114 may be any suitable device or apparatus capable of transporting fluid such as molten ink from the remote ink reservoir 104 to the printhead 32. In one embodiment, the ink delivery path 114 comprises an enclosed conduit, such as a tube, duct, or similar structure that confines the ink therein as it is being guided from the melt reservoir to the printhead.

In one embodiment, the ink delivery path 114 from remote ink reservoir 104 directs melted phase change ink to an on-board ink reservoir 116 of the printhead 32. The on-board reservoir 116 is configured to hold a quantity of melted phase change ink for delivery to the ink jets (not shown) of the printhead for ejection onto the imaging member 12. The on-board reservoir 116 may be provided with an ink level sensor 113 configured to detect or indicate the level of ink in the on-board reservoir 116. Any suitable type of ink level sensor may be used. As used herein, the term "reservoir" may be used to refer to any device, apparatus, or structure that is capable of containing a quantity of melted phase change ink therein, such as the remote reservoir, the on-board reservoir, and purged ink reservoir (described below). The term remote as used herein and as applicable to ink reservoirs refers to a reservoir that is separate or independent from the printhead on-board reservoir which feeds ink through passages to the image forming jets or nozzles. The "remote" reservoir relationship referred to herein may relate to a physical distance separation or may be integrated in a single unit with the printhead and purge reservoirs such that the reservoir functions are "remote" though in close proximity and in a common assembly.

The imaging device 10 includes a maintenance system for periodically purging ink through the nozzles of the ink jets in the ejecting face 32*a* of the printhead 32. Ink may be purged through the ink jets in any suitable manner. For example, a positive air pressure may be introduced into the on-board reservoir 116 from a suitable air pressure source (not shown). Solenoid valve 119 may be operably coupled to the on-board reservoir 116 to control the pressure in the on-board reservoir 116 in a suitable manner. The ink flows down the ejecting face 32*a* of the printhead via gravity where it is collected in by a gutter 123 which directs the ink to a purged ink reservoir, also referred to as a purged ink sump or collector 122. The system may also include a scraper or wiper blade 118 which is configured to be drawn across (e.g., in the direction indicated by the arrow 120) the ink ejecting face 32*a* of the printhead 32 to wipe any excess liquid phase change ink, as well as any paper, dust or other debris that has collected on the ejecting face down towards the gutter 123 and sump 122.

In the embodiment of FIG. 2, the purged ink collector 122 comprises a sump chamber that is incorporated into the printhead assembly 32. The sump chamber 122 is located in the printhead assembly 32 below the on-board printhead reservoir 116. In alternative embodiments, the ink collector 122 may be separate from the printhead. Molten ink captured in the ink collector 122, or sump, is directed back to the remote reservoir 104 via an ink return path 124. In one embodiment, the ink return path 124 comprises an enclosed conduit, such as a tube, duct, or similar structure that confines the ink therein as it is being guided from the sump to the printhead. One or more filters (not shown) may be positioned at various locations for filtering gross contaminants, such as paper debris and dust, from the purged ink prior to the purged ink being recovered into the remote reservoir.

To maintain the ink in liquid form during supply and recovery operations, the reservoirs and conduits used to hold and transport ink may be selectively heated by a suitable heating system to maintain an appropriate ink temperature range and such heating control may include temperature monitoring and adjustment of heating power and/or timing. Heater may be any suitable type of heating system and can rely on radiant, conductive, or convective heat to bring the ink in the reservoirs and conduits to at least the phase change melting temperature. By incorporating the purged ink collector 122 into the printhead assembly 32, the purged ink collected in the sump may be heated to a phase change ink melting temperature by the same heating system for maintaining the ink in the on-board reservoir in liquid phase, e.g. at or above the phase change ink melting temperature. In embodiments in which the purged ink is collected in a chamber separate from the printhead assembly, a dedicated heater may be provided to heat the waste ink in the collection chamber to at least the phase change ink melting temperature. A dedicated heater, however, may also be provided in the sump chamber of the printhead assembly if desired.

In previously known systems, ink delivery and recovery was controlled using two pumping systems, i.e., one for pumping ink from the remote reservoir 104 to the on-board reservoir 116 of the printhead and a second for pumping ink from the ink collector 122 back to the remote reservoir 104. Such pumping systems were typically implemented using a positive air pressure source and/or a negative air pressure source. Molten ink was delivered to the on-board reservoir by applying a positive pressure to the remote reservoir to force ink out of the reservoir, through the supply conduit, and into the on-board reservoir or by applying a negative pressure to the on-board reservoir which draws ink from the remote reservoir to the on-board reservoir via the supply conduit.

As an alternative to the use of a positive and negative air pressure source for pumping molten ink through the supply and return conduits, the molten ink delivery and recovery system 100 is configured to use a single bidirectional rotary displacement pump 128 for providing both the supply and recovery pumping operations. To enable the use of a bidirectional displacement pump 128 for pumping ink, the remote reservoir receptacle 110 is fluidly coupled to a single conduit or tube 130 that extends from the remote reservoir. The conduit or tube 130 is configured to serve as a bidirectional fluid path through which molten ink flows either in a supply direction S from the melt reservoir 104 toward the printhead on-board reservoir 116 or in a recovery direction R from the purged ink reservoir 122 toward the remote reservoir 104. The bidirectional pump assembly 128 is positioned along the bidirectional fluid path 130 to provide the pumping force for pumping the molten ink in both the supply S and recovery R directions.

Figure 4:
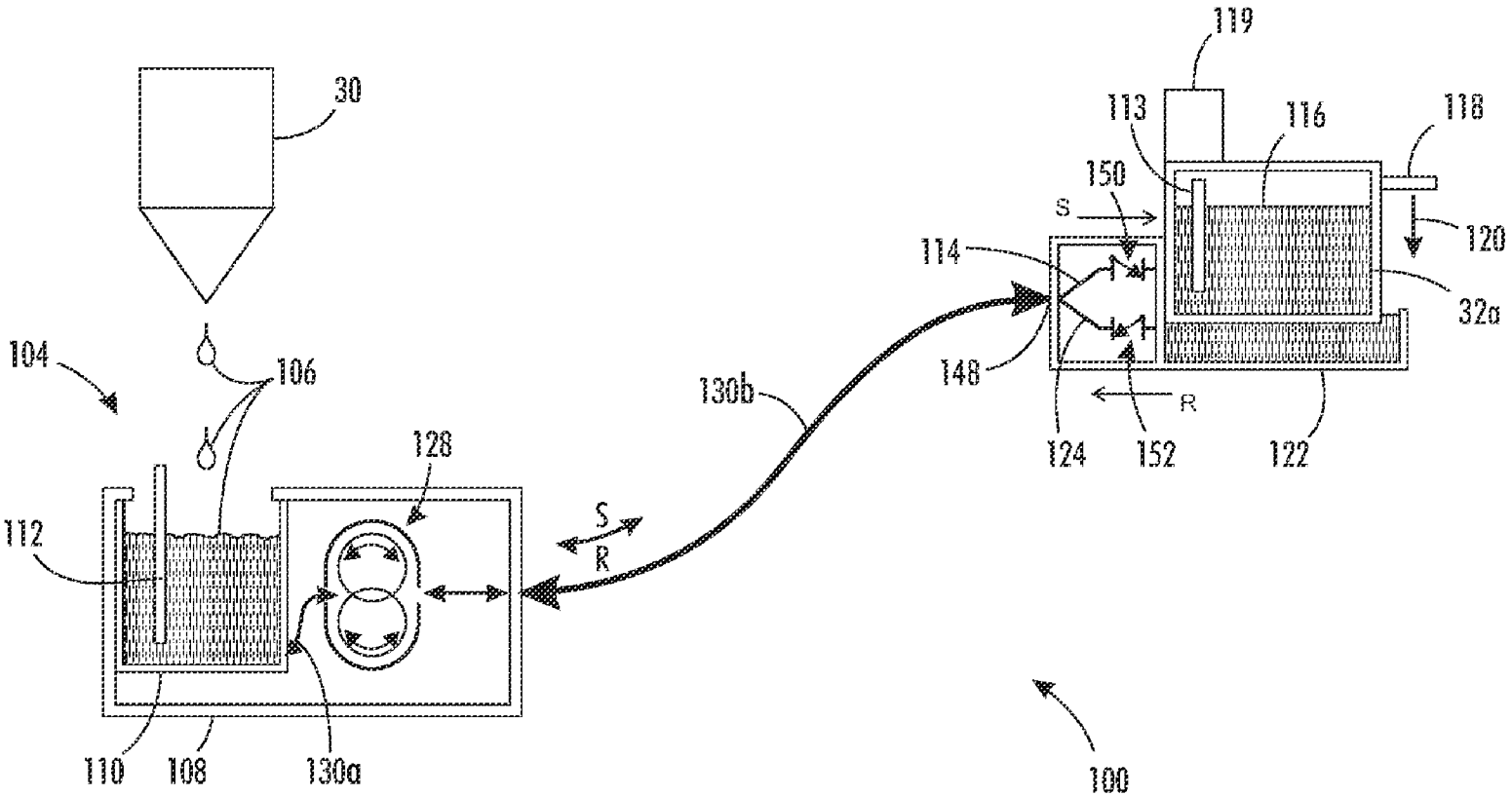
FIG. 4 is a schematic view of an embodiment of an ink delivery and recovery system with the junction adjacent the printhead.

The bidirectional conduit, the supply conduit, and the return conduit are fluidly connected at a conduit junction 148. As depicted in FIG. 2, the bidirectional pump assembly is coupled to the reservoir 104 by bidirectional conduit portion 130*a* and to the junction 148 by the bidirectional conduit portion 130*b*. The junction 148 may be provided at any suitable position relative to the melt reservoir 104 and the on-board printhead reservoir 116. For example, FIG. 2 schematically shows the junction as being adjacent the melt reservoir 104. FIG. 4 shows an embodiment in which the junction is provided adjacent the printhead 32.

Figure 3A:
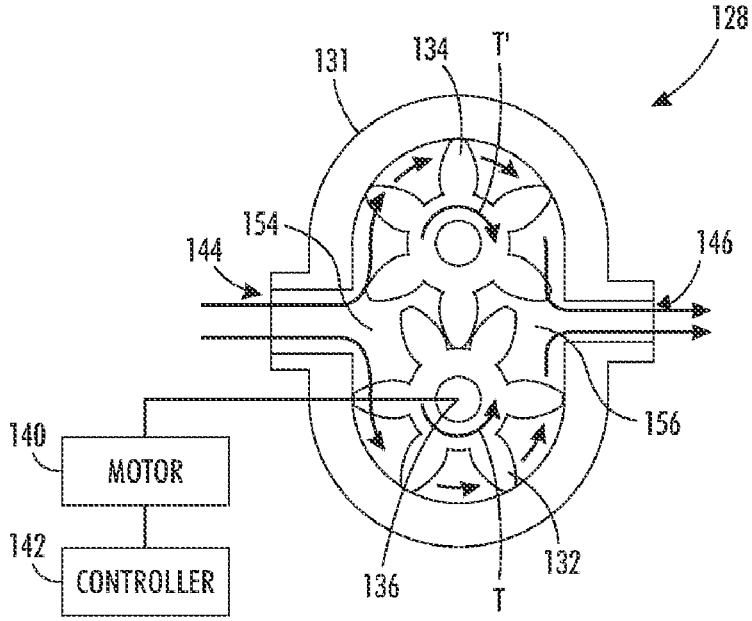
FIG. 3 is a schematic view of an embodiment of a rotary displacement pump for use with the system of FIG. 2.
Figure 3B:
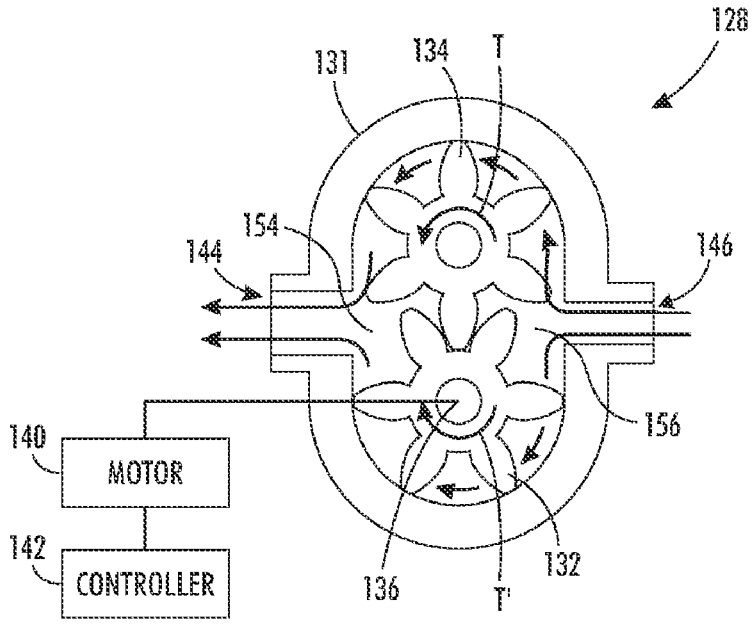

Referring now to FIGS. 3A and 3B, an embodiment of a bidirectional rotary displacement pump assembly 128 is shown. In particular, FIG. 3A shows the bidirectional pump being operated to pump ink in a first direction, e.g., in the supply direction, and FIG. 3B shows the bidirectional pump being operated to pump ink in a second or opposite direction, e.g., in the recovery direction. The rotary displacement pump of FIGS. 3A and 3B comprises a rotary gear pump assembly that includes a housing 131 defining a chamber in which at least one gear is rotatably supported. As depicted in FIGS. 3A and 3B, the gear pump comprises an external gear pump having a pair of meshed gears 132, 134. In other embodiments, any suitable type of bidirectional displacement pump may be utilized including internal gear pumps, gerotors, screw pumps, peristaltic pumps, and the like. In the embodiment of FIGS. 3A and 3B, the pair of meshed gears 132, 134 includes a drive gear 132 and driven gear 134. Drive gear 132 is mounted on a drive shaft 136 that extends through the chamber 138. Drive shaft 136 is operably connected to a suitable motor 140 for rotating the drive shaft 136 and drive gear 132 of the gear pump in response to commands received from a controller 142. Driven gear 134 is mounted on an axle for idle rotation and meshed with the drive gear 132 so that it may be rotated by the drive gear 132. Controller 142 may be implemented as part of system controller 80 of the device 10 or may comprise a standalone controller, such as an ASIC or other suitable type of microcontroller.

The pump housing 131 has a pair of diametrically opposed openings 144, 146 which, depending on the direction of flow of the molten ink, are configured to serve as inlet and outlet openings for the gear pump 128 through which molten ink flows into and out of the chamber 138. The first opening 144 is fluidly coupled to the bidirectional fluid path 130*a* to receive molten ink from the remote reservoir 104 during supply operations and to direct recovered ink to the remote reservoir 104 during recovery operations. Similarly, the second opening 146 is fluidly coupled to the bidirectional fluid path 130*b* to direct molten ink toward the on-board printhead reservoir 116 during supply operations and receive recovered ink from the ink collector, e.g., sump, 122 during recovery operations.

The delivery and recovery conduits are provided with a suitable flow path restriction, such as a valve system or other suitable back flow prevention means, which prevents molten ink from traveling in the wrong direction along either the supply conduit or recovery conduit. For example, delivery conduit 114 includes a flow restriction 150 configured to enable flow in a single direction S toward the on-board reservoir 116 and to substantially prevent the flow of molten ink in direction R. Similarly, recovery conduit 124 includes a flow restriction 152 configured to enable flow in a single direction R toward the remote reservoir 104 and to substantially prevent the flow of ink in direction S toward the ink collector 122. The flow restrictions 150 and 152 may be located at any suitable position along the respective flow paths or conduits 114 and 124. For example, the flow restrictions may be positioned at or near the ends of the conduits 114, 124 that connect to the junction 148, at or near the ends of the conduits 114, 124 that connect to the respective reservoirs 116, 122, or substantially anywhere between the ends of the conduits 114, 124. In one embodiment, the flow restrictions 150 and 152 comprise one-way check valves. As an alternative to the use of check valves as the flow restrictions for the delivery and return conduits, directional flow control may be provided at least in part dams or weirs, as they are known in the art, positioned in the supply and return paths. For instance, a dam or weir used in conjunction with a filter may be configured to serve as a one-way check valve. An example of such a system is disclosed, for example, in commonly assigned U.S. Patent Publication No. 20080122901 to Platt et al., which is hereby incorporated by reference in its entirety. Flow path restrictions or check valves may be passive or controllably actuated and may include biasing mechanisms such as springs to ensure that the valves open or close appropriately for the given flow rate or pressure in the lines.

The molten ink delivery and recovery system 100, and in particular, the bidirectional pump 128, may be operated in any suitable manner to provide molten ink to the on-board reservoir 116 and to recover molten ink from the purged ink reservoir 122. In embodiments, molten ink may be provided to the on-board reservoir based on the ink level indicated by the ink level sensor 113 of the on-board reservoir 116. For example, the ink level sensor 113 may be configured to at least indicate when the ink in the on-board reservoir has reached or passed below a predetermined level, i.e., the ink level has reached a "Low" level. In one embodiment, the ink level sensor is configured as a binary sensor that provides output indicative of whether or not the sensor is in contact with ink. Thus, an ink low condition is indicated when the sensor does not detect ink. The sensor 113, however, may be any suitable type of sensor or system capable of indicating when the on-board reservoir has reached an ink low condition.

The bidirectional pump is configured such that the pump is activated to pump ink in the supply direction S when the ink level sensor 113 indicates a low ink condition in the reservoir 116. With reference to FIG. 3A, when the ink level sensor indicates that the ink level is low, the motor 140 is activated to control gears 132, 134 so that, for example, gear 132 rotates in direction T which in turn causes gear 134 to rotate in complementary direction T' at a predetermined rate of speed so that ink is moved in the supply direction S. The first 144 and second openings 146 in the pump housing 130 are positioned with respect to the gears such that as the gears 132, 134 rotate they separate at position 154 in front of the first opening 144, creating a void and suction which is filled by molten ink from the remote reservoir 104 (via bidirectional conduit 130). The molten ink is carried by the gears 132, 134 toward the opposite side 156 of the housing where the gears 132, 134 displace the molten ink through the second opening 146. The ink then travels to the junction 148 at which point the flow restriction 150 permits the ink to travel to the reservoir 116, and flow restriction 152 prevents ink from being transported toward the purged ink collector 122. In one embodiment, the gears 132, 134 are rotated until the ink level sensor 113 indicates that the reservoir 116 has a desired level of ink. For example, with the binary sensor embodiment described above, the sensor may indicate when it is in contact with the ink at which point the gears are deactivated so that they no longer rotate to pump ink in the supply direction S.

With reference to FIG. 3B, when it is desired to recover purged ink from the ink collector 122, the gears 132 and 134 are activated by the motor 140, in response to commands from controller 142, for example, to rotate gear 132 in direction T' which in turn causes gear 134 to rotate in complementary direction T. In this embodiment, the rotating gears 132, 134 create the voids at position 156 in front of the second opening 146 that draws ink from the ink collector 122 and displace ink toward the first opening 144 towards the remote reservoir 104. Molten ink is drawn toward the melt reservoir 104 from the junction 148. The flow restriction 152 allows ink to travel from the purged ink collector 122 toward the junction while the flow restriction 150 prevents ink from being drawn from the on-board reservoir 116.

The gears may be rotated at a predetermined rate of speed for a predetermined duration to deliver purged ink from the ink collector 122 back to the remote reservoir 104. In alternative embodiments, the purged ink collector may be provided with an ink level sensor for indicating when the collected ink has reached a predetermined level at which point recovery operations should be performed. The rotational speed of the gears 132, 134 for the supply and recovery operations may be any suitable speed and may be selected based on such factors as the gear sizes, fluid path dimensions, ink flow characteristics, and the like so that a desired amount of ink is pumped through the system at a desired rate.

Figure 5:
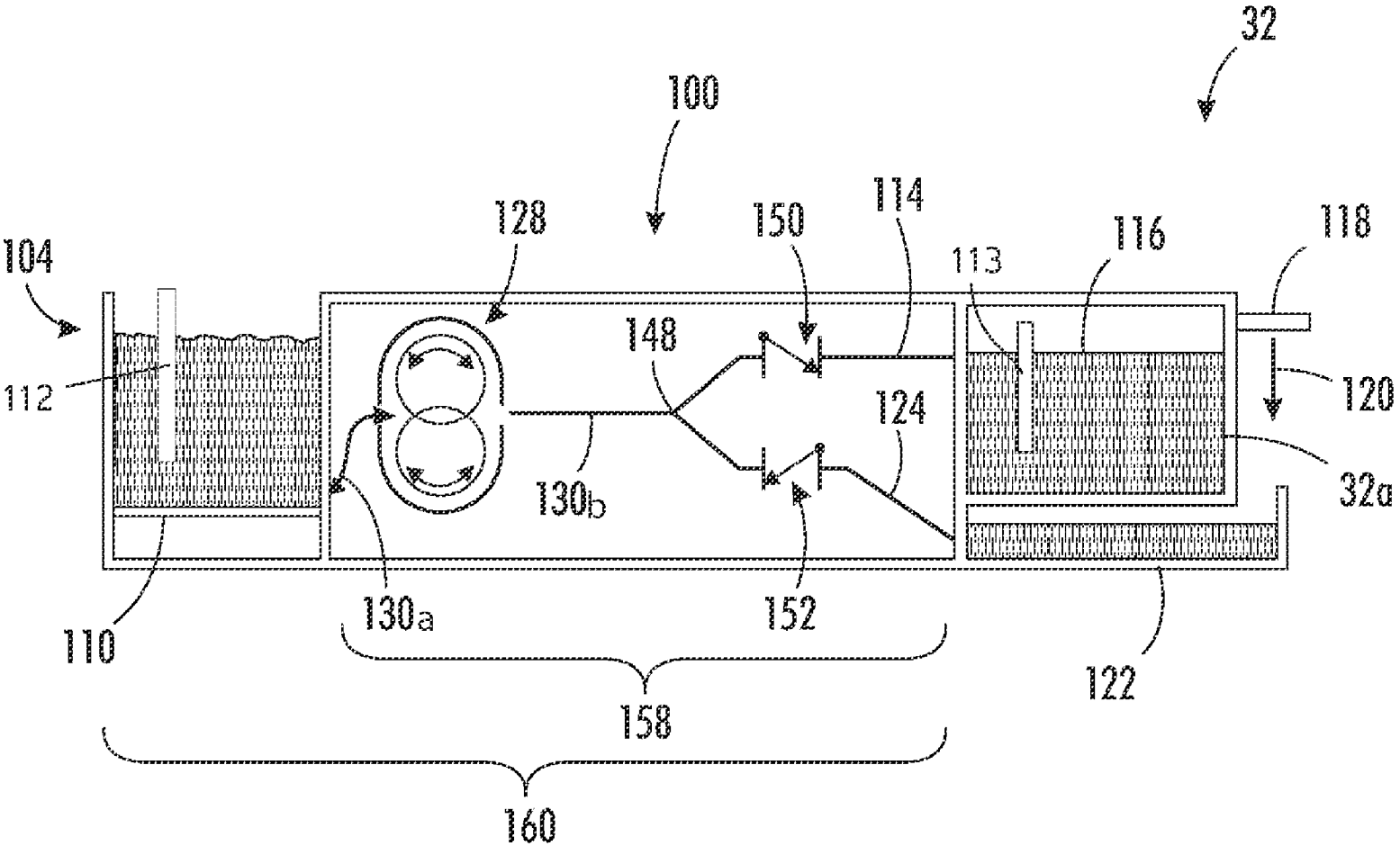
FIG. 5 is a schematic view of the ink delivery and recovery system shown as a modular unit that may be stand-alone or combined with the melt reservoir.

Although each of the components of the ink delivery and recovery system 100 may be provided and installed separately, in some embodiments, the ink delivery and recovery system 100 may be provided as a self-contained unit that may be inserted into an imaging device and connected between a remote reservoir 104 and a printhead 32 as a single unit. For example, a schematic diagram of an embodiment of a modular ink delivery and recovery system 100 is shown in FIG. 5. As depicted, the ink delivery and recovery system 100 may be provided in a housing or frame 158 that supports the delivery 114 and return 124 conduits and bidirectional pump 128 in an operable relationship with respect to each other. The housing 158 may include suitable features that enable the supply 114 and return 124 conduits to be connected to the printhead reservoir 116 and sump 122 without requiring conduits or flow paths exterior to the housing 160 although exterior conduits and connections may be used. In another embodiment, the remote reservoir and the ink delivery and recovery system 100 may be provided as a single combined unit. For example, as depicted schematically in FIG. 5, the remote reservoir 104 and the ink delivery and recovery system 100 may be provided in a housing or frame 160 that enables the reservoir 104 and supply and recovery system 100 to be operably connected between the melt assembly and the printhead reservoir.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging device comprising:

a plurality of ink jets for emitting ink toward an image receiving surface;

a first reservoir configured to contain ink, the first reservoir being associated with a printhead and being in fluid communication with a plurality of ink jets in the printhead for delivery of ink from the first reservoir to the plurality of ink jets;

a second reservoir spaced apart from the first reservoir, the second reservoir being configured to contain ink for delivery to the first reservoir;

an ink delivery and recovery system including:

a first conduit connected between the first reservoir and a junction, the first conduit including a flow path restriction that permits flow of ink in only a single direction from the junction toward the first reservoir;

a second conduit connected between the junction and the second reservoir; and a bidirectional pump associated with the second conduit and configured to pump ink in a first direction to cause ink to flow from the second reservoir toward the junction.

2. The device of claim 1 further comprising:

a third reservoir positioned to receive ink emitted from the plurality of ink jets;

the ink delivery and recovery system further including:

a third conduit connected between the third reservoir and the junction, the third conduit including a flow path restriction that permits flow of ink in only a single direction from the third reservoir toward the junction and operation of the bidirectional pump in a second direction causes ink to flow from the junction toward the second reservoir.

3. The imaging device of claim 2, the first reservoir comprising at least one on-board reservoir of at least one printhead for the imaging device.

4. The imaging device of claim 3, the second reservoir comprising a remote reservoir for the at least one printhead.

5. The imaging device of claim 4, the third reservoir comprising an ink collector for containing ink diverted from the plurality of ink jets during maintenance operations of the imaging device.

6. The imaging device of claim 1, wherein the flow path restrictions in the first and third conduits comprise one-way check valves.

7. The imaging device of claim 1 wherein the bidirectional pump is a bidirectional rotary displacement pump.

8. A liquid ink delivery and recovery system for use with a phase change ink imaging device, the system comprising:

a first reservoir configured to contain ink, the first reservoir being associated with a printhead and being in fluid communication with a plurality of ink jets in the printhead for delivery of ink from the first reservoir to the plurality of ink jets in the printhead of the phase change ink imaging device;

a second reservoir spaced apart from the first reservoir for containing ink for delivery to the first reservoir;

a third reservoir for capturing ink emitted from the plurality of ink jets;

a first conduit connected between the first reservoir and a conduit junction, the first conduit configured to permit flow of ink in only a single direction toward the first reservoir;

a second conduit connected between the third reservoir and the conduit junction, the second conduit being configured to permit flow of ink in only a single direction away from the third reservoir;

a third conduit connected between the second reservoir and the junction to enable the junction to fluidly connect the first, second, and third conduits; and a bidirectional pump associated with the third conduit for pumping ink in a first direction and a second direction in the third conduit, the first direction causing ink to flow from the second reservoir toward the junction.

9. The system of claim 8, the first reservoir comprising at least one on-board reservoir of at least one printhead for the imaging device.

10. The system of claim 9, the second reservoir comprising a remote reservoir for the at least one printhead.

11. The system of claim 10 wherein the third reservoir is positioned to receive ink emitted from the plurality of ink jets during maintenance operations of the phase change ink imaging device.

12. The system of claim 10 wherein the first and second conduits are configured with one-way check valves.

13. The system of claim 8 wherein the bidirectional pump is a bidirectional rotary displacement pump.

14. The system of claim 8 further comprising:

at least one check valve in the first conduit, the first conduit and at least one check valve being configured to permit flow of ink in only the single direction toward the first reservoir; and at least one check valve in the second conduit, the second conduit and at least one check valve being configured to permit flow of ink in only the single direction away from the third reservoir.

15. A method of operating an imaging device, the method comprising:

connecting a first conduit to an on-board reservoir associated with a printhead of the imaging device;

connecting a second conduit between a remote reservoir of the imaging device and the first conduit, the first conduit being configured to permit fluid flow in only a single direction from the second conduit toward the on-board reservoir;

connecting a third conduit between a ink collecting reservoir, which is positioned to receive ink emitted from the printhead of the imaging device, and the second conduit, the third conduit being configured to permit fluid flow in only a single direction from the purged ink reservoir toward the second conduit; and operatively connecting a bidirectional pump to the second conduit, the bidirectional pump being configured to pump ink in a first direction and a second direction in the second conduit, the second direction being a reversal of the first direction.

16. The method of claim 15 wherein the bidirectional pump is a bidirectional rotary displacement pump.

* * * * *